United States Patent [19]

Bell

[11] Patent Number: 4,809,618

[45] Date of Patent: Mar. 7, 1989

[54] PLASTIC PALLET

[76] Inventor: Joseph P. Bell, 52 Pluto Cir., N. Fort Myers, Fla. 33903

[21] Appl. No.: 170,926

[22] Filed: Mar. 21, 1988

[51] Int. Cl.[4] ..... B65D 19/00

[52] U.S. Cl. ..... 108/51.1; 108/901

[58] Field of Search ..... 108/901, 902, 53.1, 108/53.3, 53.5, 51.3, 51.1; 206/599

[56] References Cited

U.S. PATENT DOCUMENTS

| | | | |
|---|---|---|---|
| 3,228,358 | 1/1966 | Sepe et al. | 108/901 X |
| 3,424,110 | 1/1969 | Toot | 108/901 X |
| 3,675,595 | 7/1972 | Sullivan | 108/53.1 X |
| 3,750,598 | 8/1973 | Campbell et al. | 108/901 X |
| 3,762,342 | 10/1973 | Lawlor | 108/901 X |
| 3,814,031 | 7/1974 | Fowler | 108/901 X |

*Primary Examiner*—Kenneth J. Dorner
*Assistant Examiner*—José V. Chen

[57] ABSTRACT

A plastic pallet has a flat upper surface and a plurality of supporting legs. The pallet is formed of injection molded plastic or injection molded plastic foam and the legs comprise a unique structure for providing rigidity and support, along with a peripheral moat structure which includes a peripheral, downwardly-extending wall projecting from the upper surface. The recesses provide good support for the pallet while eliminating the necessity for a relief of material, to a great extent, adjacent the periphery of the pallet.

7 Claims, 2 Drawing Sheets

PLASTIC PALLET

BACKGROUND OF THE INVENTION

1. Field of the Invention

The present invention is directed to a pallet for supporting a load such that the pallet and the load may be readily pickup by a fork lift truck and transported.

2. Description of the Prior Art

Pallets of this type normally are constructed of wood and may weigh as much as 30 pounds or more, as set forth in U.S. Pat. No. 3,640,229. As disclosed in that publication, wood pallets are constructed, generally by hand, from a plurality of pieces of wood and, as expected, deterioration takes place with age and insects, as well as a possible loosening of the parts of the pallets, such that the pallets loose much of their original rigidity.

As also set forth in my patent, pallets of plastic, particularly one-piece structures, may be easily molded and may be constructed for mutual nesting so that the aforementioned deterioration is obviated and, as a result of the nesting, less stacking and storage space is required.

SUMMARY OF THE INVENTION

The object of the present invention is to improve on plastic pallets such that a flat load space is provided, peripheral rigidity and internal rigidity is provided and nesting is provided so that such pallets may have an extended life and, of course, greater use.

In the past, 95% of all pallets have been made of wood, this going back to approximately 1972. Pallets were made of wood for two reasons, first of all lost cost of lumber and a plentiful supply of lumber. Secondly, the ease of manufacturing permitted numerous shops to produce pallets. The equipment required was a simple power saw and a nailing machine. As a result, very competitive products were provided at a small profit margin.

Lumber has become scarce so that manufacturers have reduced production to a great extent and larger users protect their sources of supply until substitutes are available.

As to plastic pallets, in Oct. 1972, the Modern Plastic Magazine stated that plastic pallets are becoming a stronger force in the market. Their researchers estimated that the current U.S. pallet market, in 1972, was 160,000,000 units per year with a 5% or more increase each year and the prediction was that plastic pallets will increase from less than 5% of the market in 1972 to capture 50% or more of the market in 1980. This has proven to be substantially correct.

As an example of economy, a wooden pallet 42″×42″ will average five trips in excess of $1.00, with maintenance, and a disposal cost of approximately the same amount per unit. A plastic pallet, however, will average 25 trips with a scrap value return on each pallet. It is therefore abundantly clear that plastic pallets will, for the most part, replace wood pallets.

A plastic pallet constructed in accordance with the present invention can be made by injection molding or by structural foam injection molding. The materials may vary from polyethylene, polypropylene, polyvinylchloride (PVC), polychloride butyrates (PCB) and acrylic butyrate styrenes (ABS) plastics.

A plastic pallet, as set forth below, can be easily stacked for storage and loading trucks for shipment.

A plastic pallet is lightweight, strong and durable, as previously disclosed in the aforementioned United States Letters Patent, which has been fully incorporated herein by reference.

A plastic pallet has a four-way entry for the hand lift truck or a mechanized lift truck.

A pallet constructed in accordance with the present invention has an outer moat to strengthen and keep the plastic pallet from bending under a lift load.

A pallet constructed in accordance with the present invention has, in the present example, six outer extended legs that are able to remain on shelves or racks without falling off or bending on the shelves or racks.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
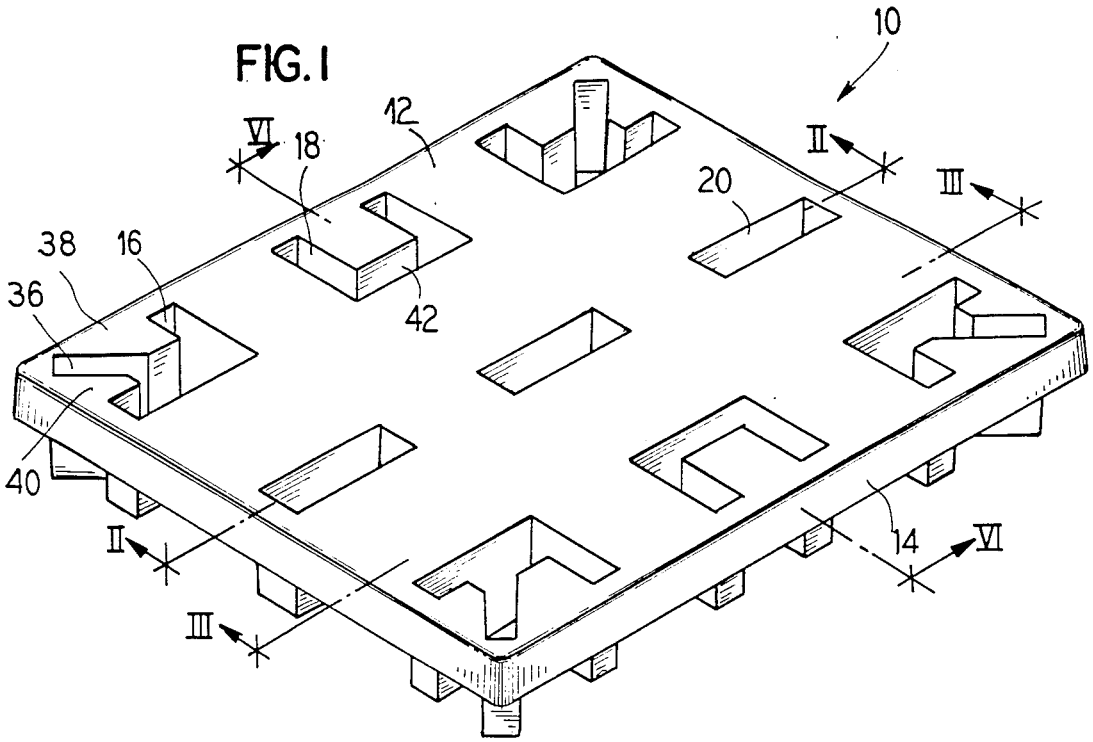
FIG. 1 is a perspective view of a pallet constructed in accordance with the present invention.
Figure 2:
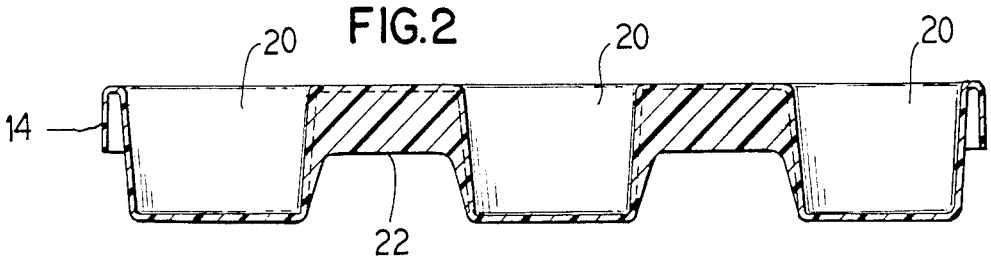
FIG. 2 is a sectional view taken generally along the parting line II—II of FIG. 1.
Figure 3:
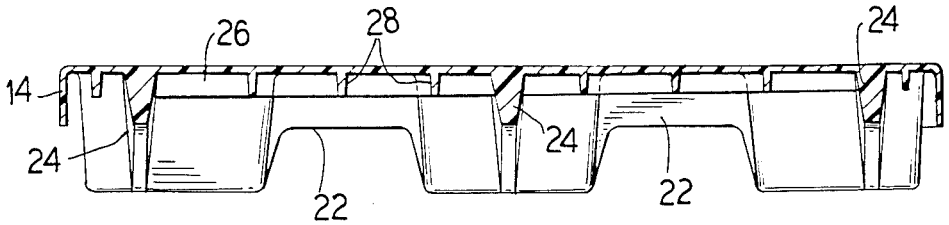
FIG. 3 is a sectional view taken generally along the line III—III of FIG. 1.

Referring to the drawings, FIG. 1 illustrates a pallet at 10, generally comprising a flat upper surface 12, having a peripheral down-turned wall 14 bordering a rectangular configuration, and a plurality of recesses 16, 18, 20 opening at the upper surface 12, and extending, tapered, downwardly to form supporting feet.

Figure 4:
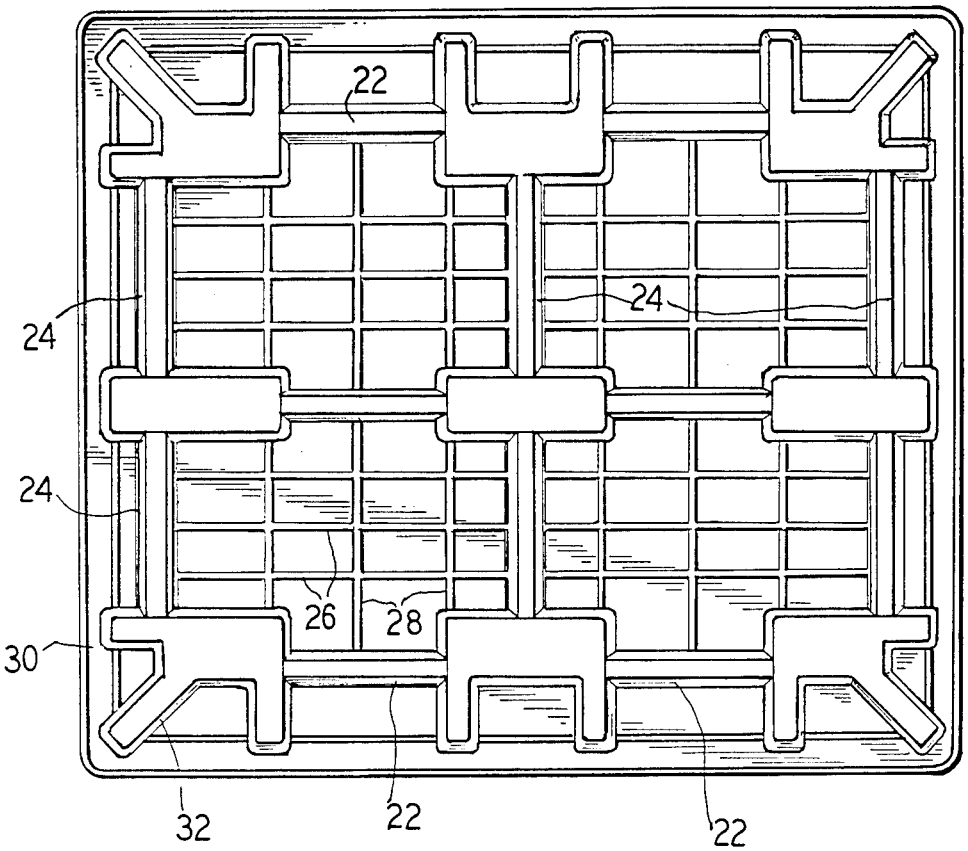
FIG. 4 is a bottom view of the pallet of FIG. 1.
Figure 5:
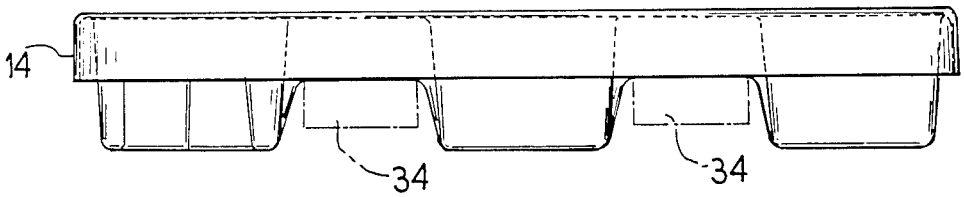
FIG. 5 is an end view of the pallet of FIG. 1 as viewed in the general direction of the sectional views II and III.
Figure 6:
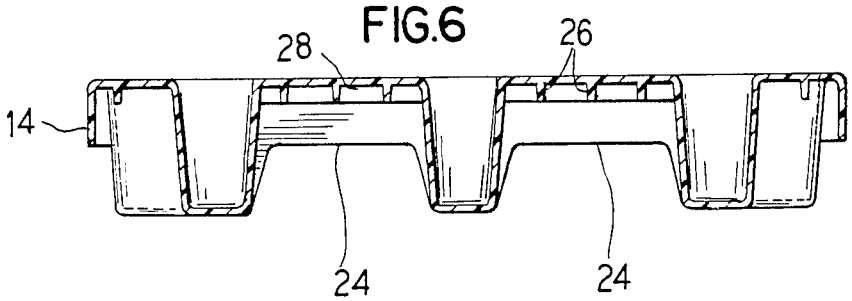
FIG. 6 is a sectional view taken generally along the parting line IV—IV of FIG. 1.

As viewed in one direction, a plurality of lifting ribs 22 are molded, horizontally as viewed in FIG. 4, and a plurality of lifting ribs 24 are molded orthogonally to the ribs 22.

A further plurality of strengthening ribs 26 are provided on the bottom surface of the upper wall orthogonally to a plurality of additional ribs 28. The lifting ribs 22, 24 and the strengthening ribs 26, 28 are clearly evident in FIGS. 2-6.

Referring to FIG. 4, each of the recesses includes a bottom wall, as indicated at 30, with a tapering sidewall, as indicated at 32, to accommodate nesting in that the side walls converge, in each instance, and also with respect to the lifting ribs 22, 24, so that nesting may be readily accomplished.

Of particular importance is the configuration of the recesses 16 and 18. It will be noted that the recesses 16, as shown in FIG. 1, have an awkward F or K configuration and that the recesses 18 have a U-shaped configuration. With respect to the recesses 16, three legs are illustrated in which none of the legs reduce, to any extent, the material adjacent the periphery of the pallet, namely in the areas 38 and 40, as indicated by the central leg 36. Somewhat the same is true with respect to the recesses 18 which are U-shaped, so that the support material, as indicated at 42, is massive with respect to the material relieved adjacent the periphery.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A plastic pallet comprising:

an upper wall including a flat upper surface defining a rectangle;

a peripheral wall extending downwardly from said upper wall; and a plurality of recesses spaced about said upper wall forming support feet and extending downwardly from said upper surface, each of said recesses opening at said flat upper surface and including downwardly and inwardly tapering side walls connected to the upper wall and a bottom wall connected to said sidwalls and closing the bottoms of said recesses, first ones of said recesses located adjacent the corners of said rectangle and each including a first leg extending towards one of the sides of said rectangle, a second leg extending towards an adjacent side of said rectangle, and a third leg extending between said first and second legs towards the respective adjacent corner of the rectangle.

2. The plastic pallet of claim 1, and further comprising:

a plurality of orthogonally-located lifting ribs for engaging the tines of a fork lift truck, each of said lifting ribs extending between adjacent ones of said recesses.

3. The plastic pallet of claim 1, and further comprising:

a bottom surface on said upper wall; and a plurality of strengthening ribs extending from said bottom surface in an orthogonal pattern.

4. The plastic pallet of claim 1, wherein:

second ones of said recesses are located between said first ones of said recesses and each comprise a U-shaped cross-section.

5. The plastic pallet of claim 1, wherein second ones of said recesses are located between said first one of said recesses and each of said second ones includes a rectangularly shaped recess.

6. The plastic pallet of claim 1, wherein a rectangularly shaped recess is provided in the center of the upper wall and between the first ones of said recesses.

7. The plastic pallet of claim 1, wherein second ones of said recesses are located between first ones of said recesses and each comprises a U-shaped configuration.

* * * * *